United States Patent [19]

McCorkel

[11] Patent Number: 4,635,863

[45] Date of Patent: Jan. 13, 1987

[54] REVERSIBLE, AXIALLY FED, CAGE ROTOR IMPACT BREAKER

[75] Inventor: Franklin M. McCorkel, Leola, Pa.

[73] Assignee: Aggregates Equipment, Inc., Leola, Pa.

[21] Appl. No.: 629,210

[22] Filed: Jul. 9, 1984

[51] Int. Cl.[4] ..... B02C 13/02; B02C 13/28

[52] U.S. Cl. ..... 241/188 A; 241/189 R

[58] Field of Search ..... 241/188 R, 188 A, 189 R, 241/189 A, 285 R, 285 A, 285 B

[56] References Cited

U.S. PATENT DOCUMENTS

| | | | |
|---|---|---|---|
| 370,880 | 10/1887 | Mathiason | 241/188 A |
| 3,003,708 | 10/1961 | Leonard | 241/189 R X |
| 3,360,207 | 12/1967 | Shelton, Jr. | 241/285 A |
| 3,701,485 | 10/1972 | Kimble et al. | 241/32 |
| 4,017,035 | 4/1977 | Stuttmann | 241/189 R |

*Primary Examiner*—Howard N. Goldberg
*Assistant Examiner*—Timothy V. Eley
*Attorney, Agent, or Firm*—Martin Fruitman

[57] ABSTRACT

An impact rock crusher which imparts motion to the rocks by a rotating open cage rotor within the enclosure. Rocks are fed in above one end of the spinning cage in a direction parallel to the axis of the cage and are thrown against multiple bars located near the walls of the enclosure. The space between the cage and the lower peripheral bars is hydraulically adjustable for control of the size of output material. The entire enclosure is constructed in two halves so that they can be separated for access to the interior for servicing.

1 Claim, 6 Drawing Figures

REVERSIBLE, AXIALLY FED, CAGE ROTOR IMPACT BREAKER

SUMMARY OF THE INVENTION

This invention deals generally with solid material disintegration and more specifically with a rock breaker using centrifugal force created by a spinning cylindrical cage of bars.

Impact breakers to break rock are well established in the field. Such breakers use a solid rotor constructed with protrusions in its surface to literally break or impact rocks into pieces. Such breakers also have a series of breaker bars located radially outward from the rotor which aid in the breaking action by serving as impact points for rocks and pieces of rocks which are thrown against them by the rotating rotor bars. The size of the rock at the output of the crusher is determined by the space between the rotor and the breaker bars in the lower part of the breaker, as well as the spacing between the breaker bars, where rocks will fall or be driven between the rotor and the nearest breaker bar, or between the breaker bars and then out of the bottom of the breaker. In most instances, conventional single rotor breakers discharge opposite the feed end and are non-reversible.

Numerous problems exist with such breakers, many of them being a direct result of the great force and destructive power involved in such machines. For instance, it is not uncommon for one or more of the outer breaker bars to be worn thin in the central region, to then break, and for the two parts to fall within the crusher and to cause further damage by their being thrown about within the crusher.

A common fault is the "loading up" of the crusher by fines and small pieces which do not fall through the exit, but rather, continue to be tossed about within the same machine. Such material causes some resistance to the movement of the rotor causing increased wear within the machine and requiring more horse power than would be the case without such loading.

Another problem common to all impact breakers is the cost of maintenance caused by the wearing away of the striking surfaces of the rotor and breaker bars and the down time required to remove, reverse, and re-install the bars to present a new striking surface.

A further complication in the existing machines is the great difficulty in securing access to the interior of the units for repair and servicing. This is so because of the heavy structural enclosure which is needed to prevent accidental discharge of rocks, and the typical need to unbolt and remove large plates for access. Even then, most servicing requires personnel to enter through entry plates and work within the restricted confines of the interior of the machine.

Finally, since all such impact rock breakers feed the uncrushed rock in one end of the machine, that is, in a direction radial to the rotating cylinder, they have a severe limitation as to the size of rock which can be accommodated. The width of any piece of rock, most of which are of a slab configuration, is clearly limited to the length of the rotor cylinder. A rock slab with a width greater than the length of the rotor must be turned on end in order for it to enter the machine. Efforts to accomplish such turning result in frequent jam-ups in the rock feed.

The present invention overcomes each of these problems associated with impact rock crushers. It accomplishes this essentially by replacing the impact rotor with a spinning cage of impact rods; rods similar to those stationary rods previously used only on the periphery of the machine. The peripheral rods may still remain, and the breaking action is similar to that of a conventional impact breaker in that rocks not broken by initial contact with the rotor, or spinning cage, are propelled outward and impacted against the peripheral rods. In addition, the open cage provides for breakage within the cage as the rocks pass through it. The open cage solves the problem of loading up the machine with smaller rocks and fines because it provides an additional exit for the reduced material when compared with the traditional machines. The smaller material can exit, not only through the space between the cage and the nearest peripheral breaker bars, but also through the central region of the cage itself. Such a construction increases the exit area for smaller material by an order of magnitude and virtually eliminates "loading up". The motor power source for the rock breaker of the invention can therefore be reduced below that of similarly rated conventional units or, similarly, for the same power its capacity can be increased.

Increase in feed size capacity is accomplished through another feature of the invention; the axial side loading. As explained above, the end loading of the crushers imposes a limitation on the width of the rock slabs which can be fed into the machines. The width of rocks must be less than the length of the crusher's cylinder.

Axial feed eliminates that limitation. When a slab is fed into the machine parallel to the axis of the cage, as in the present invention, the slab width is not limited by the diameter or width of the cage. In the present invention, the feed is centrally located above the axis of the cage at one side of the machine. This location yields several other advantages.

Side feed allows for the operation of the cage rotor in either clockwise or counter-clockwise rotation, which approximately doubles the tonnage of material which may be reduced without the necessity of shut-down for replacement, reversal, or welding build-up of the worn rotor and breaker bars.

Also, the machine may now accommodate additional side peripheral breaker bars covering the region which would otherwise be devoted to a feed chute. Such additional bars provide additional breaking action, but also yield manufacturing economies since the machine is now symmetrical about the cage axis, and the two ends can be built exactly identical.

The absence of the end feed chute also permits another improvement in access to the machine for service. With the feed chute on the side, the two halves of the housing chamber of the present invention are built to separate from each other by sliding apart to permit walk-in and crane access to service the cage and other internal machine parts.

To accomplish this, the external housing of the machine is literally split down the middle, along the vertical plane through the cage axis, and is mounted on a steel skid support base. Access to the machine interior can therefore be accomplished by unclamping the two halves from each other and the base, and moving the halves back on the base, preferably by a hydraulic power drive. Such movement permits full and comfortable access to both sides of the cage and to all the peripheral breaker bars for inspection and occasional replacement.

The feed chute also splits in two halves, each attached to one half of the housing, so that it also is moved out of the way as the housing is separated. Moreover, the design permits the addition of a similarly split return feed chute, used for recycling material, on the opposite side of the axis of the cage, with no interference with access for servicing.

Another unique feature of the present invention is the rectangular breaker bars, as opposed to the typical round units. Such rectangular bars dramatically decrease glancing blows which merely deflect rocks rather than break them. Moreover, the rectangular design also permits turning and reversing the bars to maintain a rectangular breaking surface after the bars become rounded by wear. The peripheral breaker bars also include a locking device which holds them in place at each end so that, even if a bar is broken completely into two pieces, the pieces cannot fall into the machine.

The invention also includes a provision to adjust the position of the peripheral bars to change the size of the material exiting from the machine. The lower sets of bars, those which are closest to the cage, are adjustable as to their clearance distance from the cage. Two groups of these bars, one on each side of the cage, are mounted in holders which are pivoted at their higher ends and are hydraulically controlled to position their lower ends closer or farther from the cage. The actual distance between the cage and the nearest peripheral bar determines the largest piece of rock which may fall through to exit the crusher.

The hydraulic control for the above adjustable breaker bars has the additional function of providing for tramp iron release in the event unbreakable material enters the breaking chamber. Hydraulic pressure holds the lower sets of bars in the desired position with pressure maintained in an air accumulator. This air accumulator acts as an emergency pressure chamber allowing the adjustable breaker bars to pivot out and away from the tramp iron so that it may safely clear the machine while overcoming the normal operating hydraulic pressure holding the adjustable bars in position. After the tramp iron has passed the increased pressure built up in the accumulator by the force of the tramp iron against the adjustable bars causes the bars to again be repositioned against shim blocks for normal operation.

The cage itself is constructed of two or more replaceable impact bars. These bars are held onto the cage structure by a unique arrangement to facilitate replacement. The cage is essentially constructed of at least two rotor discs; one at each end of the cage, with a central shaft. More rotor discs are added with increased length of the cage, and typically, a third rotor disc is used for central support on most common size breakers.

These rotor discs have cutouts around their circumference into which the breaker bars fit. The bars are then locked into the cutouts by end plates which fit around the ends of the bars which protrude beyond the rotor discs. The end plates, bolted flat against the rotor discs lock the bars onto the rotor discs but are split into several independent segments, so that a limited number of bars can be released without loosening all of the bars on the cage.

The combination of the rotating cage and axial feed yields a more effective, higher capacity crusher of smaller dimensions than the previous end loading, solid cylinder units. Easy access for servicing and ease of breaker bar replacement also add significantly to the utility of the present invention.

Alternate embodiments of the invention include a cage rotor supported on only one end of the axis so that it can be fed simultaneously to the inside and the outside of the rotor, and a crusher with no peripheral impact bars. In the latter embodiments flat or serrated liner plates are used as peripheral impact areas.

DETAILED DESCRIPTION OF THE INVENTION

Figure 1:
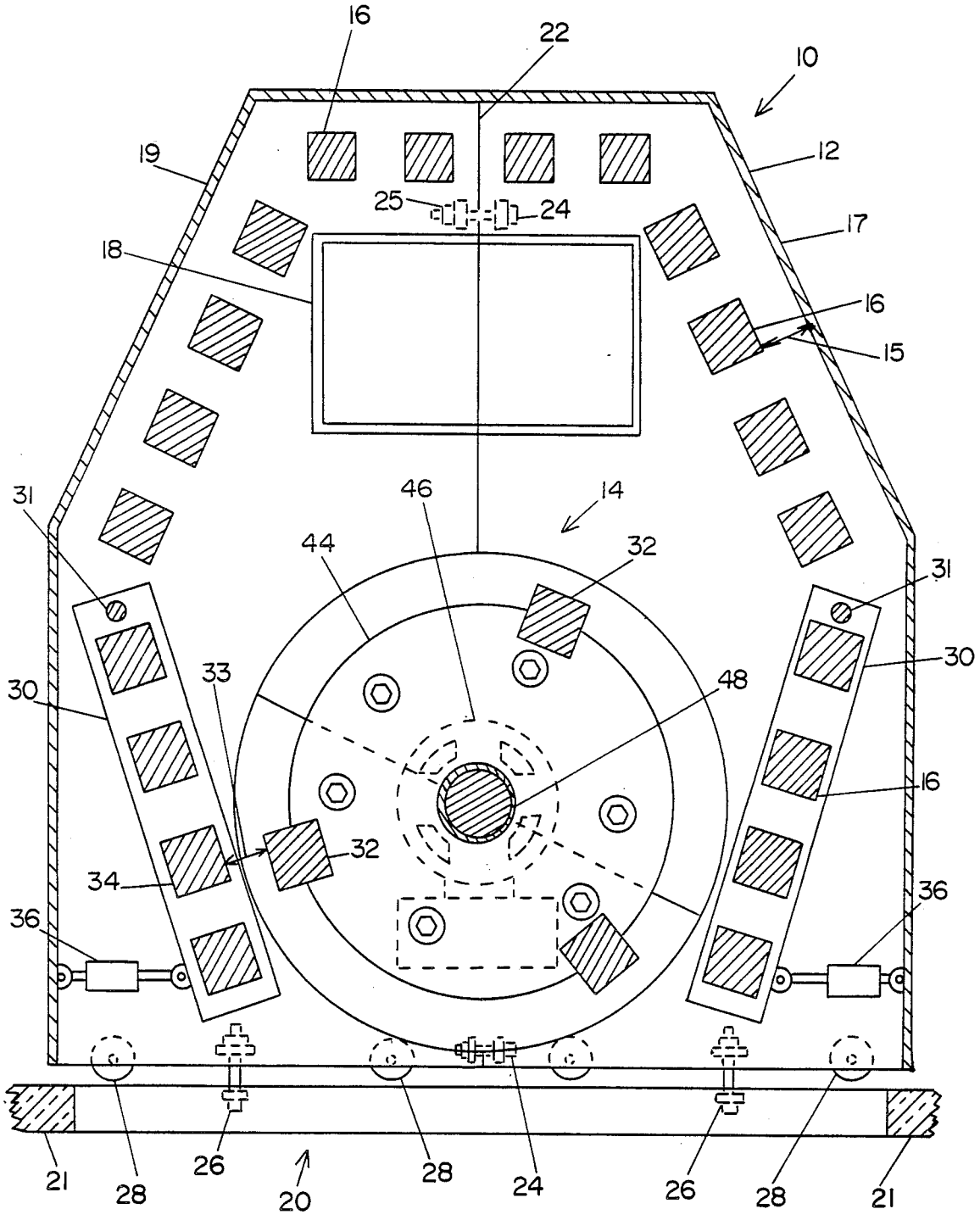
FIG. 1 is a highly simplified cross section view of a crusher of the preferred embodiment taken transverse to the cage axis. in the middle of the axial length of the cage.

The preferred embodiment of the invention is shown in highly simplified form in FIG. 1 which is a cross section of the impact crusher taken across the axis of the rotor cage near the midpoint of the axial length of the rotor cage. This cross section of impact crusher 10 is actually the same over most of the length of impact crusher 10 with the obvious exceptions of the two ends.

The essential elements of impact crusher 10 are housing 12, rotor cage 14, peripheral bars 16, and entry chute 18. These elements interact to perform the rock crushing action when rotor cage 14 throws rocks around the enclosure and onto peripheral bars 16. Entry chute 18 is centrally located at one axial end of rotor cage 14 and rocks sliding along entry chute 18 essentially drop onto rotor cage 14 from above. The crushed rock leaves impact crusher through exit 20 which is an opening in base structure 21, supporting crusher 10, which essentially aligns with the open bottom of housing 12.

Housing 12 is constructed in two matching sections 17 and 19 divided at boundary 22, held together by clamping means 24, attached to base 21 by removable anchors 26 and separable from each other by either or both of sections 17 and 19 being rolled away from each other on wheels 28. Once uncoupled from each other by releasing clamping means 24 and anchors 26, sections 17 and 19 can be rolled apart by various motive means (not shown). A system as basic as a chain pulled by a tractor or a more complex system of permanently attached hydraulic motors can be used to provide the motion. Similarly, clamping means 24, while depicted at upper location 25 as a simple nut and bolt clamp, can also be a quick clamp arrangement which releases on only a few turns. Anchor 26 can be constructed with similar variations.

The entire purpose of the movement of the two sections 17 and 19 of housing 12 is to permit easy access to the interior of impact crusher 10 by service personnel who can then stand upright while performing repairs and who also have suitable clearance for the use of tools.

Entry chute 18 is also split, as housing 12 is, and each segment is attached to the appropriate section 17 or 19 of housing 12. The movement of sections 17 and 19, therefore, also divides and separates entry chute 18 into two parts which, when mated, enclose and join to a short length of a permanent, non-separable, conveyor (not shown) feeding material to impact crusher 10.

Peripheral breaker bars 16 are mounted throughout impact crusher 10 so that rocks thrown by rotor cage 14 will strike bars 16 and be broken, and several aspects of bars 16 are of particular value.

Bars 16 are all the same size and are all rectangular in cross section. The rectangular configuration yields several distinct advantages over the typical round bars. Particularly, the bars have a flat surface exposed to the center of the crusher so rocks will hit the bars squarely and fewer will strike glancing blows. The actual force on rocks hitting straight on is greater, so more effective breakage is the result. The rectangular bars also yield an economy in regard to servicing since bars worn on one side, with, for instance, corners broken off can be turned to yield a new breaking face as opposed to being replaced.

Breaker bars 16 throughout the crusher are mounted individually, except for the lower sets which are mounted on a frame 30, pivoting on axis 31, to permit adjustment of output clearance 33 between bar 32 of rotor cage 14 and bar 34 of frame 30.

Frame 30 is constructed with a duplicate frame at the other axial side of crusher 10 and the frames are held together by the breaker bars themselves. Hydraulic cylinder 36 is used to adjust the clearance and is controlled externally by a control (not shown), but hydraulic cylinder serves an additional purpose. It provides for an impact overload system. Such a system is required to prevent occasional scrap iron in the stone, called "tramp iron" from jamming the machine. With the hydraulic cylinder, a pressure operated overload system is used, so that when the impact surpasses design limits, the cylinder releases and prevents damage to the crusher.

Figure 2:
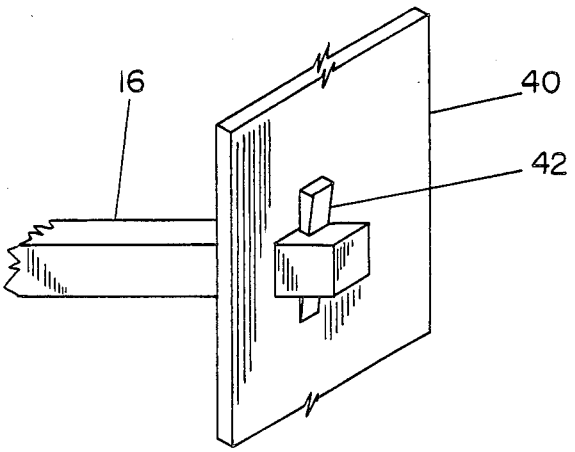
FIG. 2 is a view of the end of a peripheral breaker bar showing the capture means.

Breaker bars 16 are held in place by a simple key system as shown in FIG. 2. This capture means is used both for those bars attached to frames 30 and the other peripheral bars 16 which are similarly held by the end plates of housing 12. In FIG. 2, breaker bar 16 slips through a clearance hole in end plate 40, which can be either the end plate of housing 12 of crusher 10 or the end plate of frame 30. Key 42 is then driven into a mating hole in breaker bar 16, and with a similar arrangement at the other end of breaker bar 16, is sufficient to lock it in place. Moreover, key 42 prevents a breaker bar 16 from falling into the crusher even if breaker bar 16 should itself break due to wear and high impact. This simple expedient of key locking the breaker bars, therefore, reduces the possibility of machine damage due to breaker bar failure.

Peripheral breaker bars 16 are located with some active machine space 15 on their sides remote from the rotor cage. Along with open cage rotor 14, this design aids in preventing crusher 10 from loading up with fines and smaller rocks. The space 15 behind peripheral bars 16 permits smaller material to pass between bars 16 and exit the machine without being contacted by and interfering with the motion of rotor 14.

Figure 3:
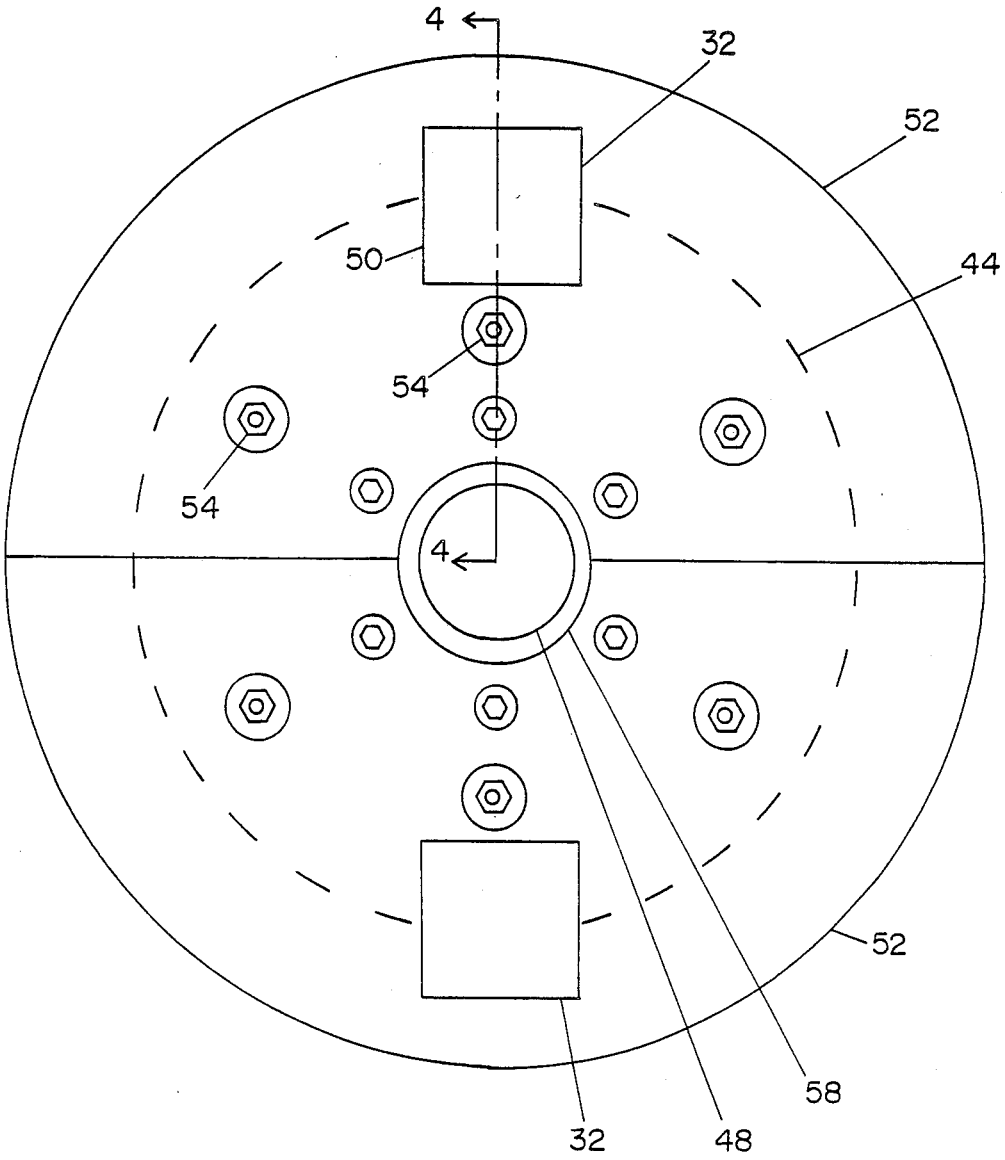
FIG. 3 is a view of the end of rotor cage of an alternate embodiment of the invention.
Figure 4:
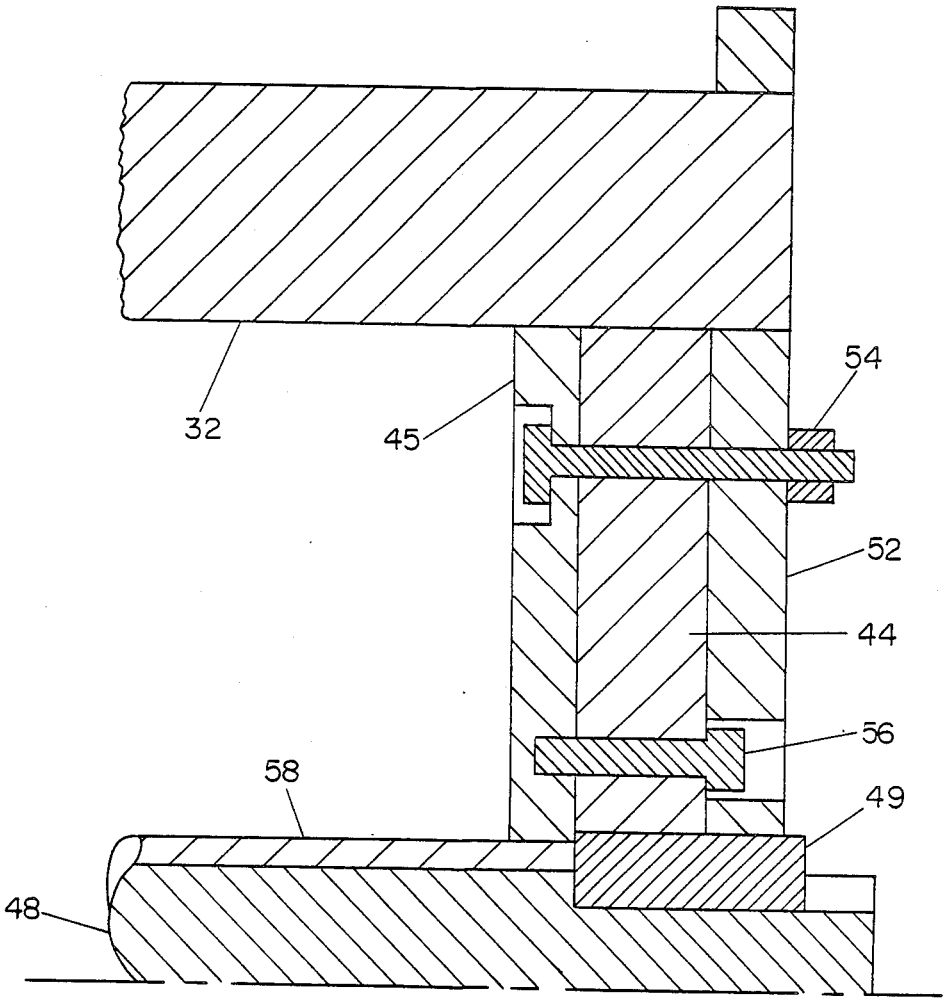
FIG. 4 is a partial cross section of the end region of the cage taken through the axis of the cage of FIG. 3.

Rotor cage 14 is the very heart of the present invention. As shown in FIGS. 1, 3 and 4, it is, however, little more than square breaker bars 32 held by specially designed rotor discs 44 and spun by reversible motor 46, shown in invisible lines at the far end of shaft 48. The reversibility of motor 46 permits extending the life of the breaker bars, both on the rotor cage and the peripheral bars, by occasionally reversing the motion and changing the wear patterns on the bars. This reversibility is only possible because of the symmetry of the machine which results from axial feed.

FIG. 3 is an end view of an alternate embodiment of a rotor cage which holds two breaker bars, but the system for retention of the bars within the rotor cage is applicable, regardless of the number of bars. Rotor disc 44 is cut out along its circumference with clearance slots 50 into which impact bars 32 fit and by which they are supported. Rotor disc 44 is conventionally attached to shaft 48, but keyed to shaft 48 by key 49 to increase rigidity of the rotating mass and thereby increase impact. Impact bars 32 are held in place and further supported by retainers 52 which are two semicircular plates extending beyond the radial position of impact bars 32 and including square cut outs to fit over impact bars 32. Since impact bars 32 extend beyond rotor disc 44, as is better seen in FIG. 4, a view through section 4—4 of FIG. 3, retainers 52 fit over the ends of impact bars 32. Retainers 52 are then attached to rotor disc 44 by bolts and nuts 54. Removal of impact bars after use, even if greatly distorted, is a simple matter because the area of interface between impact bar 32 and retainer 52 is not subject to impact by rocks.

Several shields shown in FIG. 3 and FIG. 4 are placed specifically to protect other areas of the crusher from damage. Shaft liner 58 is, for instance, used to shield shaft 48. It is a split cylinder and may itself be discarded and replaced if damaged. Similarly, disc liner 45 is bolted to the inside of rotor disc 44 by means of bolts 56 and can also be easily removed and replaced. Disc liner 45 is also used to hold shaft liner 58 onto shaft 48 by clamping liner 58 at its junction with rotor disc 44. Other similar protective liners are used throughout crusher 12 to protect other components. For instance, as in other types of crushers, liners (not shown) are used to protect the housing's inside surfaces from damage.

Figure 5:
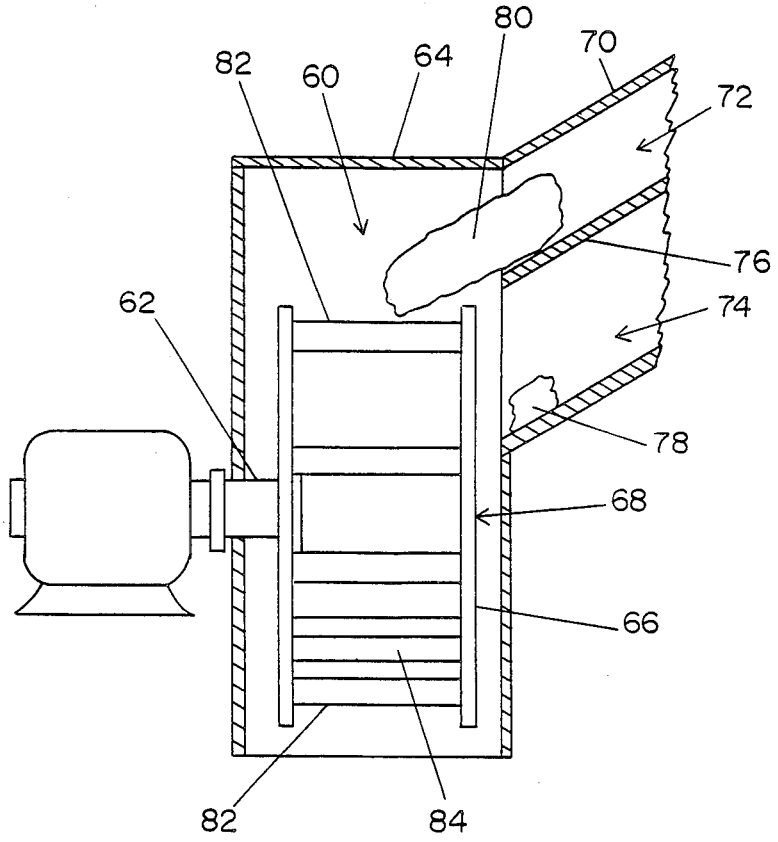
FIG. 5 is a view of the axial length of an alternate embodiment of the invention showing a rotor supported from only one axial end.

FIG. 5 shows an alternate embodiment of the invention in which rotor cage 60 is supported on only one side by axis 62. FIG. 5 is a simplified partial view of the impact crusher depicted with the near half of housing 64 removed for viewing the interior.

Figure 6:
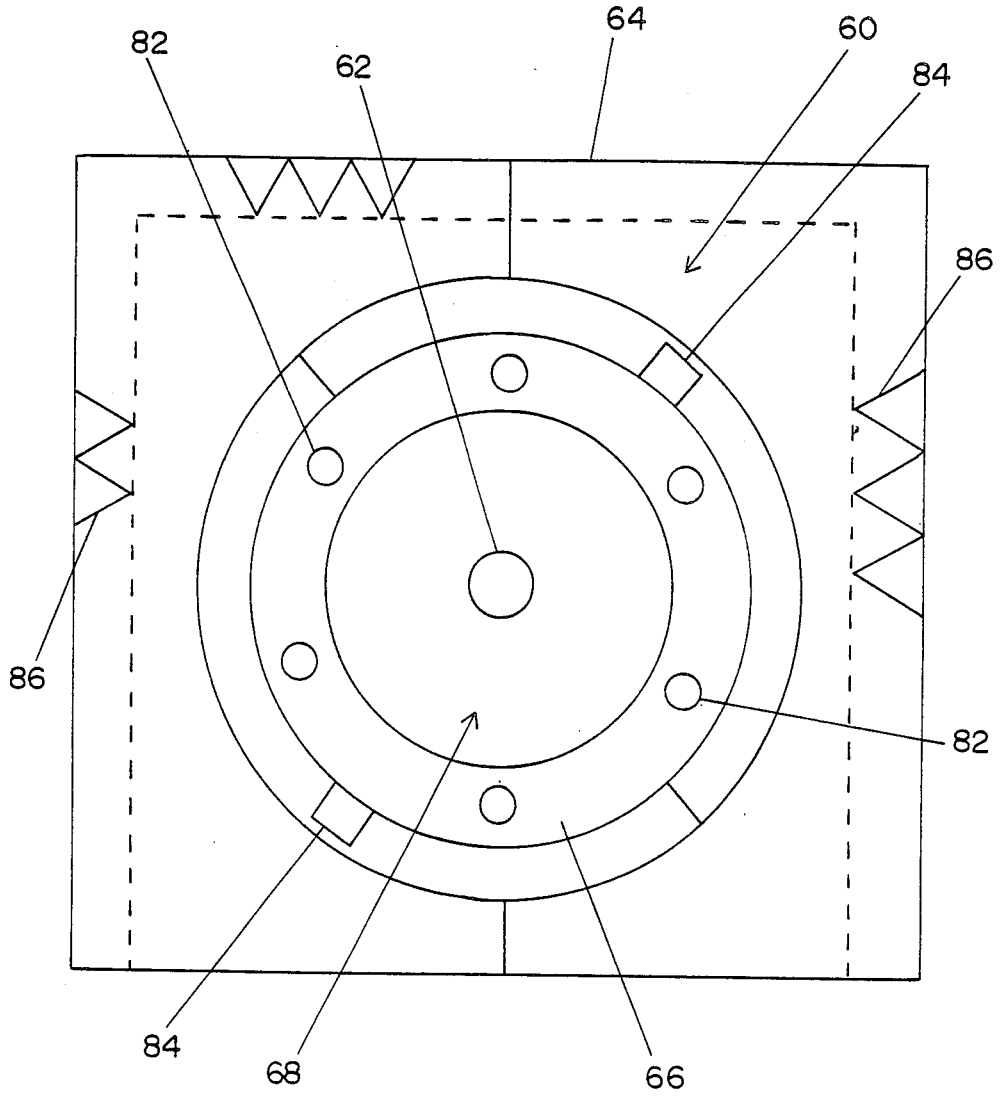
FIG. 6 is an axial end view of embodiment of FIG. 5.

FIG. 6 is an axial end view of the same embodiment showin in FIG. 5, with the axial-side cover plate removed, showing that the distinguishing feature of rotor cage 60 is that rotor plate 66 has central opening 68 in it to permit feeding materials to the machine both outside and inside rotor cage 60. Therefore, as shown in FIG. 5, entry chute 70 is divided into an upper section 72 and a lower section 74 by divider 76, which permits feeding different sized materials to the regions inside and outside rotor cage 60.

This permits the crusher to operate both as a secondary crusher and a tertiary crusher either in sequence or similtaneously. Conventionally, material is moved from a primary crusher to a secondary crusher and then to a tertiary crusher as the size of the material is reduced. Typically, an open rotor machine can be used only with material specially sized for it, since large rocks are merely thrown to the outer circumference of the rotor cage and retained there by centrifugal force.

The embodiment shown in FIG. 5 and FIG. 6 can, however, accept smaller material 78 in lower section 74 for delivery through opening 68 into the interior of rotor cage 60, and also accept larger material 80 in upper section 72 for delivery to the exterior of rotor cage 60 for crushing action similar to that described for the preferred embodiment.

To aid in this action rotor cage 60 includes not only conventional round impact bars 82, but also additional protruding impact bars 84 which aid in agitating and breaking the larger material on the outside of rotor cage 60.

The machine shown in FIG. 6 also incorporates serated liners 86 to aid in the crushing process, as opposed to the peripheral breaker bars previously shown.

It is to be understood that the form of the invention herein shown in merely a preferred embodiment. Various changes may be made in the size, shape and the arrangement of parts; equivalent means may be substituted for those illustrated and described; and certain features may be used independently from others without departing from the spirit and scope of the invention as defined in the following claims.

For instance, more rotors can be added with their axis parallel to that of the first, located near the first, to yield a crusher with greater capacity. Also, entry chute 18 could be located in a top panel of housing 12 rather than in a side panel as shown in FIG. 1. This would be particularly convenient in an impact crusher without peripheral impact bars.

What is claimed as new and desired to be secured by Letters Patent of the United States is:

1. An impact crusher for rocks comprising:

a base structure;

a housing with side walls, a top and end walls, resting upon the base structure;

a feed chute attached to the housing and opening into the interior of the housing so as to feed entering material to the outside of a rotor cage within the housing;

a shaft located within the housing with its axis parallel to the end walls;

a motor attached to and driving the shaft; and a rotor cage attached to the shaft comprising end plates, at least one of which is attached to the shaft, and which hold a first group of rotor breaker bars with at least one rotor breaker bar radially outward from the shaft and parallel to it to form a cage structure rotated by the shaft;

wherein only a first end plate is attached to the shaft and a second end plate is constructed with a central opening, together forming a rotor cage with access to the interior, and wherein the feed chute is located to deliver material to the interior of the rotor cage through the central opening in the second end plate; and further including more than one feed chute, wherein one chute delivers material to the interior of the rotor cage and a second chute delivers material external to the rotor cage.

* * * * *